US010026577B2

(12) United States Patent
Hiroki et al.

(10) Patent No.: US 10,026,577 B2
(45) Date of Patent: Jul. 17, 2018

(54) CONTACT SWITCHING DEVICE

(71) Applicant: OMRON Corporation, Kyoto-shi, Kyoto (JP)

(72) Inventors: Kazuchika Hiroki, Kumamoto (JP); Shingo Mori, Yamaga (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 15/237,769

(22) Filed: Aug. 16, 2016

(65) Prior Publication Data

US 2017/0069452 A1 Mar. 9, 2017

(30) Foreign Application Priority Data

Sep. 4, 2015 (JP) ..... 2015-174869
Jun. 17, 2016 (JP) ..... 2016-121171

(51) Int. Cl.

*H01H 67/02* (2006.01)
*H01H 51/29* (2006.01)
*H01H 9/44* (2006.01)
*H01H 50/54* (2006.01)
(Continued)

(52) U.S. Cl.

CPC ..... *H01H 51/29* (2013.01); *H01H 9/443* (2013.01); *H01H 50/546* (2013.01); *H01H 51/06* (2013.01); *H01H 2001/545* (2013.01); *H01H 2205/016* (2013.01); *H01H 2213/00* (2013.01); *H01H 2223/002* (2013.01); *H01H 2235/01* (2013.01)

(58) Field of Classification Search

CPC ..... H01H 1/54
USPC ..... 335/16, 147, 195, 126, 131
See application file for complete search history.

(56) References Cited

U.S. PATENT DOCUMENTS 3,887,888 A * 6/1975 Bayles ..... H01H 1/54 200/250
3,991,290 A * 11/1976 Bayles ..... H01H 1/54 200/250
(Continued)

FOREIGN PATENT DOCUMENTS

CN 102834891 A 12/2012
JP 2012-104356 A 5/2012
(Continued)

OTHER PUBLICATIONS

Chinese office action dated Jan. 24, 2018 in a counterpart Chinese Patent application.

*Primary Examiner* — Alexander Talpalatski
(74) *Attorney, Agent, or Firm* — Metrolexis Law Group, PLLC

(57) ABSTRACT

There is provided a contact switching device which has high productivity and in which operation characteristics hardly vary. The contact switching device includes an electromagnetic unit, a holder, a movable shaft, a movable yoke, a movable contact piece having movable contacts at both ends, fixed contacts, and a fixed yoke. At the time of excitation of the electromagnetic unit, the movable shaft moves to the holder side along a direction of an axis center. A magnetic circuit is formed of the fixed yoke and the movable yoke due to a magnetic field generated by a current that flows into the movable contact piece as a result of the movable contacts coming into contact with the fixed contacts. The movable yoke is then attracted to the fixed yoke.

10 Claims, 14 Drawing Sheets

(51) Int. Cl.
*H01H 51/06* (2006.01)
*H01H 1/54* (2006.01)

(56) References Cited

U.S. PATENT DOCUMENTS

| | | | | |
|---|---|---|---|---|
| 5,959,517 | A * | 9/1999 | Wieloch | H01H 81/04 218/22 |
| 8,138,863 | B2 * | 3/2012 | Tanaka | H01H 1/54 335/126 |
| 8,138,872 | B2 * | 3/2012 | Yoshihara | H01F 7/1615 335/124 |
| 2013/0012037 | A1 | 1/2013 | Enomoto et al. | |
| 2013/0335177 | A1 * | 12/2013 | Enomoto | H01H 1/20 335/192 |
| 2014/0002215 | A1 * | 1/2014 | Ionescu | H01H 1/54 335/18 |

FOREIGN PATENT DOCUMENTS

| | | | |
|---|---|---|---|
| JP | 2013-243110 | A | 12/2013 |
| JP | 2014-157829 | A | 8/2014 |

* cited by examiner

CONTACT SWITCHING DEVICE

CROSS-REFERENCE TO RELATED APPLICATION

This application is based on Japanese Patent Application No. 2016-121171 filed with the Japan Patent Office on Jun. 17, 2015, and Japanese Patent Application No. 2015-174869 filed with the Japan Patent Office on Sep. 4, 2015, the entire contents of which are incorporated herein by reference.

FIELD

The present invention relates to a contact switching device, and particularly relates to a contact switching device suitable for a power loading relay, an electromagnetic switch, or the like.

BACKGROUND

In the related art, as a conventional contact switching device, for example as shown in FIG. 5A of JP 2012-104356 A, a pair of through holes 61*a* is provided on the upper surface of a container 61 made of a heat-resistant material such as ceramic. Then, fixed terminals 33, 33 are respectively inserted and brazed into the pair of through holes 61*a*. Further, a yoke body 63 is located between the pair of fixed terminals 33, 33, and fixed to the inner upper surface of the container 61. The yoke body 63 has a substantially parallelepiped shape and is made of a magnetic material such as soft ion.

When movable contacts 34, 34 provided in a movable contactor 35 come in contact with the fixed contacts 32, 32, respectively, to allow an electric current to flow, a magnetic field is generated in the movable contactor 35. A holder 81 is thereby attracted to the yoke body 63, to reduce electromagnetic repulsive force that is generated between the movable contact 34 and the fixed contact 32. As a result, the reduction prevents a decrease in contact pressure, and prevents welding of the movable contact and the fixed contact 32 in association with an increase in contact resistance. Further, with generation of the electromagnetic repulsive force, the movable contact 34 and the fixed contact 32 are opened and an arc is generated, thereby preventing the welding of the movable contact 34 and the fixed contact 32.

However, in the above contact device, the yoke body 63 needs to be fixed, for example by brazing, to the inner upper surface of the box-shaped container 61. Hence, the fixing operation requires proficient skills and an assembly operation takes time, resulting in low productivity and high manufacturing cost.

Further, in the foregoing assembly operation, an assembly error easily occurs and the high positioning accuracy is hardly achieved, thus causing a problem that operation characteristics easily vary.

SUMMARY

In view of the above problems, an object of the present invention is to provide a contact switching device which has high productivity and in which operation characteristics hardly vary.

A contact switching device according to the present invention includes: an electromagnetic unit; a holder mounted in the electromagnetic unit; a movable shaft having one end inserted through the inside of the holder and the other end inserted through the inside of the electromagnetic unit, and supported reciprocatably in a direction of an axis center; a movable contact piece provided at the one end of the movable shaft in the holder and housed in the holder, while having a pair of movable contacts disposed on the front surface on the opposite side to the electromagnetic unit in the axis center direction of the movable shaft; a movable yoke disposed on the rear surface of the movable contact piece on the electromagnetic unit side in the axis center direction of the movable shaft, and assembled to the one end of the movable shaft in the holder; a pair of fixed contacts disposed in the holder and facing the pair of movable contacts in a contactable and separable manner; and a fixed yoke located between the pair of fixed contacts, and supported as a result of placing both ends thereof in a longitudinal direction that intersects with the axis center direction of the movable shaft and intersects with a longitudinal direction of the movable contact piece. The contact switching device is configured such that, at the time of excitation of the electromagnetic unit, the movable shaft moves in a direction from the electromagnetic unit to the holder along the axis center direction, that a magnetic circuit is formed of the fixed yoke and the movable yoke due to a magnetic field generated by a current that flows into the movable contact piece as a result of the pair of movable contacts coming into contact with the pair of fixed contacts, and that the movable yoke is magnetically attracted to the fixed yoke.

According to the present invention, the fixed yoke is supported by the holder as a result of placing both ends of the fixed yoke in the holder, thereby eliminating the need to fix the fixed yoke by brazing or the like to the inner upper surface of the box-shaped container as is done in the conventional example. Hence, the assembly operation is simply performed, leading to high productivity and low manufacturing cost.

Further, since both ends of the fixed yoke only have to be placed in the holder, it is possible to obtain a contact switching device where an assembly error hardly occurs and the operation characteristics hardly vary.

DETAILED DESCRIPTION

Figure 1:
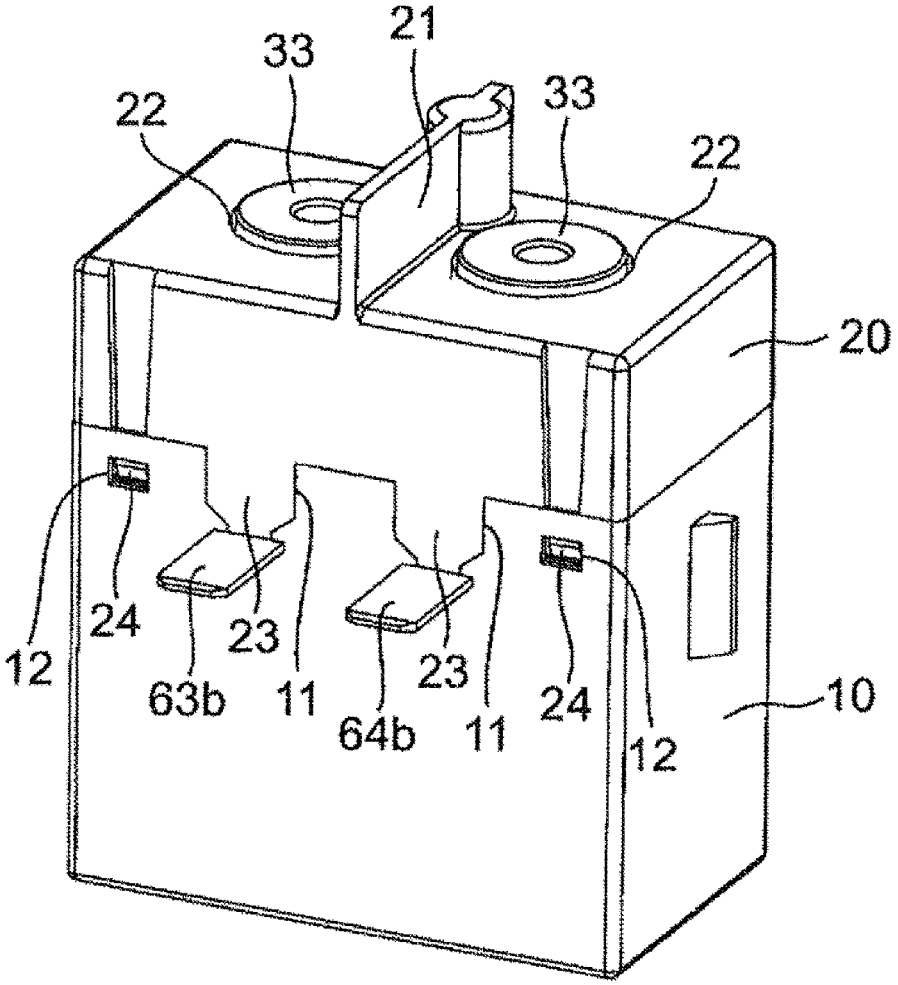
FIG. 1 is an overall perspective view showing a contact switching device according to an embodiment of the present invention.

A description will be given of an instance where a contact switching device according to an embodiment of the present invention is applied to a sealed electromagnetic relay, in accordance with the attached drawings of FIGS. 1 to 17.

The sealed electromagnetic relay according to the embodiment is configured to include at least an electromagnetic unit 60, a holder 35, a movable shaft 43, a movable contact piece 49, a movable yoke 48, a pair of fixed contacts 33*a*, and a fixed yoke 51. Specifically, as shown in FIGS. 1 to 5, a contact mechanism unit 30 and the electromagnetic unit 60 are incorporated into a housing formed by assembling an outer cover 20 to a case 10.

Figure 2:
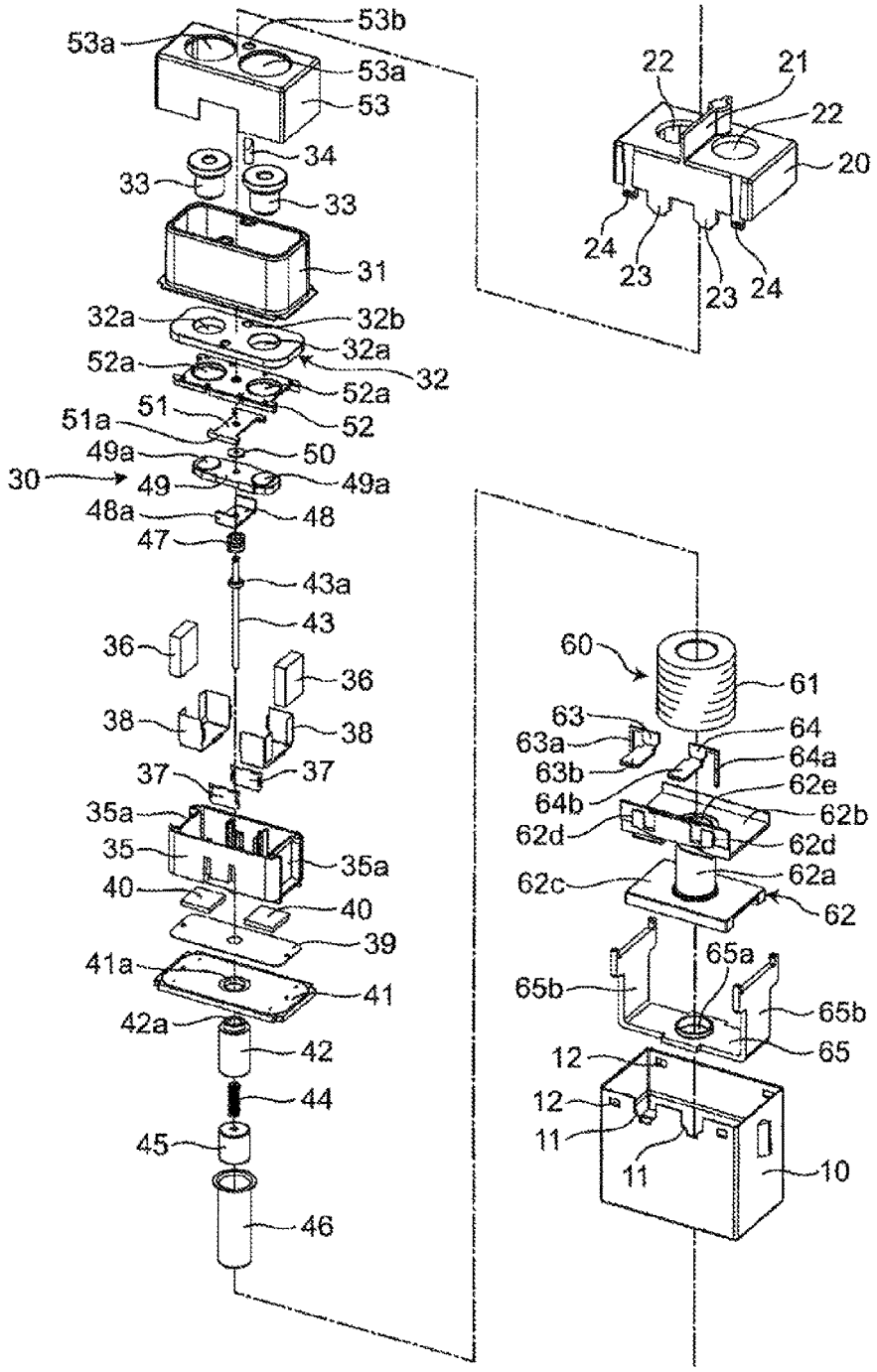
FIG. 2 is an exploded perspective view of the contact switching device shown in FIG. 1.
Figure 3:
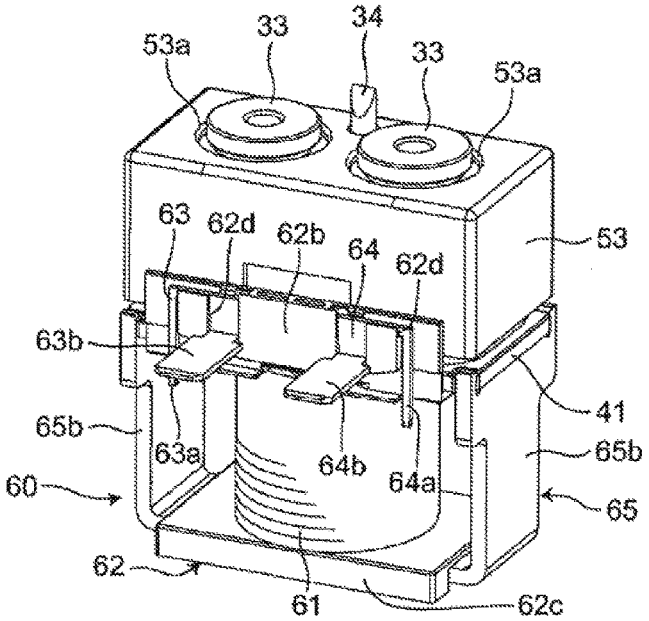
FIG. 3 is a perspective view showing a state where a case and an outer cover are removed from the contact switching device shown in FIG. 1.
Figure 4:
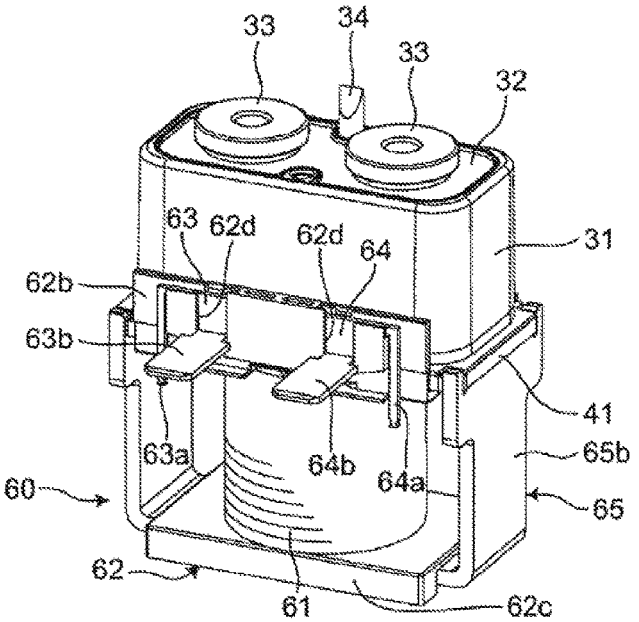
FIG. 4 is a perspective view showing a state where an inner cover is removed from the perspective view shown in FIG. 3.
Figure 5:
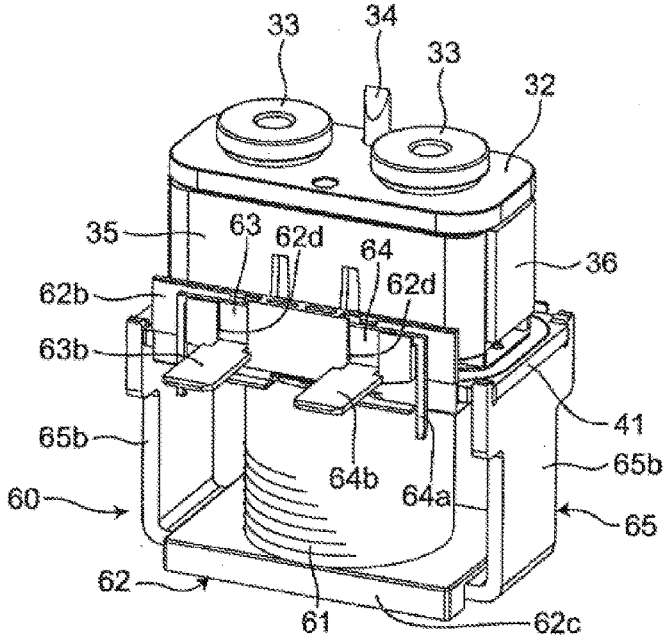
FIG. 5 is a perspective view showing a state where a metal cylindrical flange is removed from the perspective view shown in FIG. 4.

As shown in FIG. 2, the case 10 is an insulating resin molded article in a substantially quadrilateral box shape. A set of notches 11 is formed on one side of the opening edge of the case 10. Further, at both ends of the opening edges on the facing lateral surfaces of the case 10, a total of two pairs of locking holes 12 are provided.

The outer cover 20 has insulating properties and the shape of a quadrilateral box with a plane shape capable of covering the opening of the case 10. On both sides of an insulating partition wall 21 projecting from the center of the upper surface of the outer cover 20, terminal holes 22, 22 are respectively provided. Further, fitting tongue pieces 23 which are fit to the notches 11 of the case 10 are projecting from one lateral surface of the outer cover 20. Moreover, in the outer cover 20, two pairs of locking claws 24 that are locked to two pairs of locking holes 12 in the case 10 are extended from the opening edges of the facing lateral surfaces.

The contact mechanism unit 30 is configured to include the holder 35, a cylindrical fixed iron core 42, the movable shaft 43, a movable iron core 45, and the movable contact piece 49, and is incorporated into a sealed space formed of a metal cylindrical flange 31, a ceramic plate 32, a platy first yoke 41, and a bottomed cylinder 46.

As shown in FIG. 2, the metal cylindrical flange 31 has a substantially quadrilateral box shape formed by pressing a metal plate. The ceramic plate 32 is then brazed to the outer peripheral edge of the upper end of the metal cylindrical flange 31. Further, the outer peripheral edge of the lower end of the metal cylindrical flange 31 is integrated, by welding, into the platy first yoke 41 described later.

Figure 10:
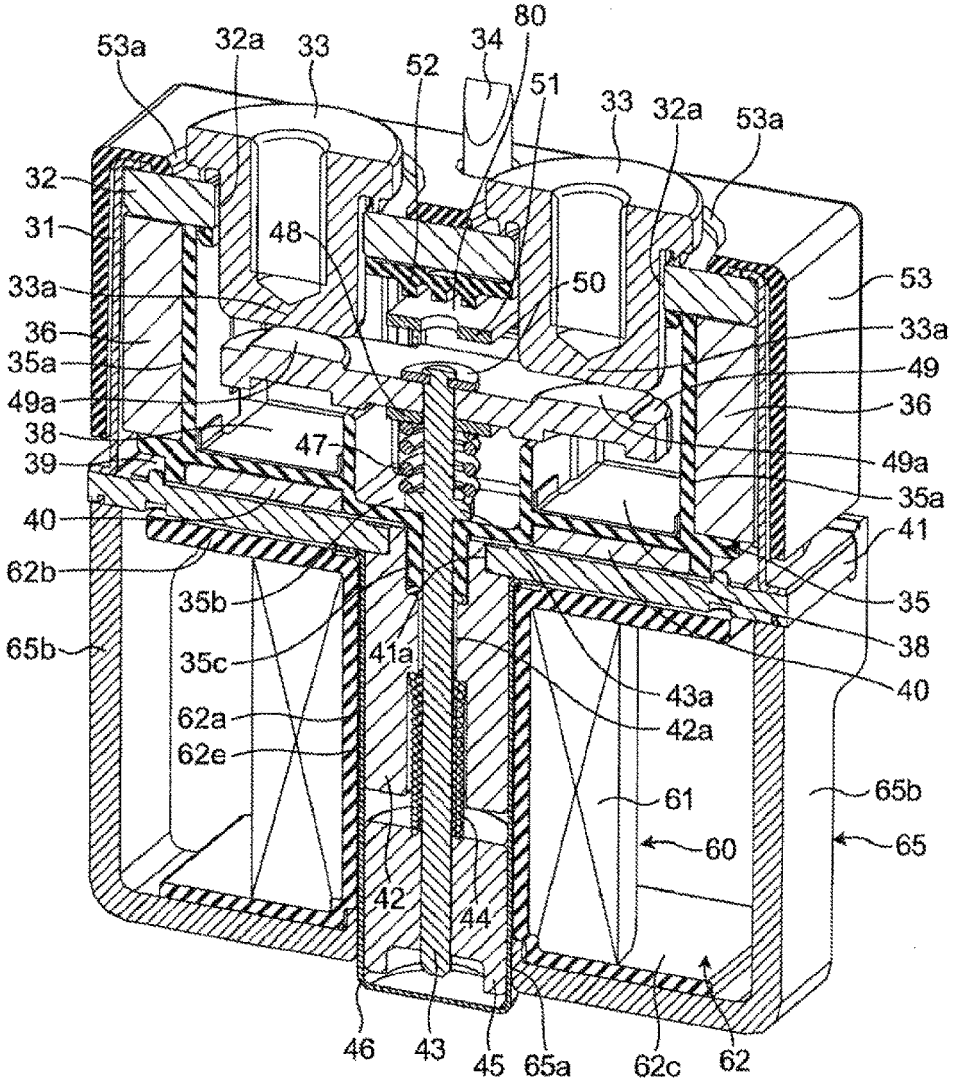
FIG. 10 is a front longitudinal sectional view before operation illustrated in the perspective view shown in FIG. 3.
Figure 11:
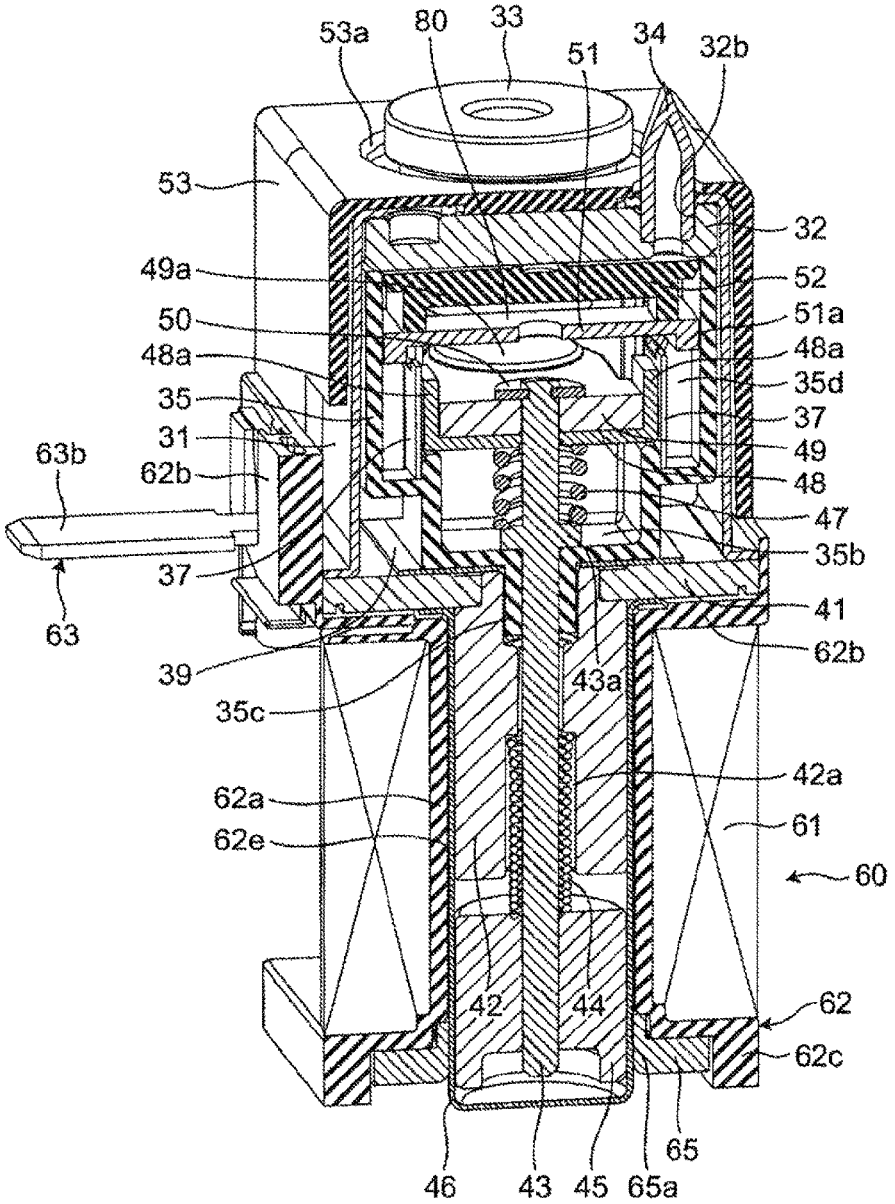
FIG. 11 is a lateral longitudinal sectional view before the operation illustrated in the perspective view shown in FIG. 3.

The ceramic plate 32 has a plane shape that can be brazed to the opening edge of the upper end of the metal cylindrical flange 31. Further, the ceramic plate 32 is provided with terminal holes 32*a*, 32*a*, and a gas vent hole 32*b*. In the ceramic plate 32, a metal layer, not shown, is formed at each of the opening edge of the terminal hole 32*a* and the opening edge of the gas vent hole 32*b*. Then, as shown in FIG. 10, a fixed contact terminal 33, having the fixed contact 33*a* fixed to its lower end, is brazed to the terminal hole 32*a* of the ceramic plate 32. Accordingly, the fixed contact 33*a* is disposed in the holder 35 and faces a movable contact 49*a* in a contactable and openable manner. Further, as shown in FIG. 11, a gas vent pipe 34 is brazed to the gas vent hole 32*b* in the ceramic plate 32.

Figure 15:
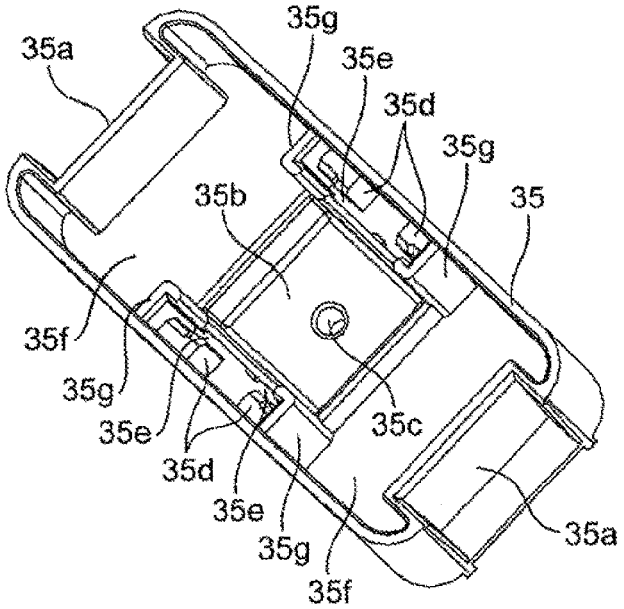
FIG. 15 is a perspective view of a holder shown in FIG. 9.

The holder 35 is mounted in the electromagnetic unit 60, is formed of heat-resistant insulating material having a quadrilateral box shape, and is housed in the metal cylindrical flange 31 (FIG. 10). As shown in FIG. 15, a pocket part 35*a* capable of holding a permanent magnet 36 is formed on each of the facing outside surfaces on both sides of the holder 35. Further, in the center of the bottom surface of the holder 35, a central recess 35*b* having a planar square shape is provided to be one stage lower than the bottom surface. A cylindrical insulator 35*c* (FIG. 10) is projecting downward from the center of the central recess 35*b*. When an arc is generated, even if a voltage becomes high through a channel of the metal cylindrical flange 31, the platy first yoke 41, and the cylindrical fixed iron core 42, the cylindrical insulator 35*c* insulates the cylindrical fixed iron core 42 and the movable shaft 43 from each other, to thereby prevent these from being welded and integrated. Further, a pair of pedestals 35*d* are respectively provided on bases of the facing inside surfaces of the holder 35. The respective pedestals 35*d* are configured of projections projecting from the bases of the respective inside surfaces of the holder 35, and having the same heights. Then, a slit 35*e* for supporting a position regulating plate 37 described later is provided between each of the pedestals 35*d* and the central recess 35*b*. Further, a recess 35*f*, in which an arc extinguishing piece 38 described later can be disposed, is provided between the central recess 35*b* and the pocket part 35*a* in the holder 35. Moreover, position regulating ribs 35*g*, 35*g* are projecting from both longitudinal sides of the movable contact piece 49 of each of the pedestals 35*d*. Then, as shown in FIG. 2, the holder 35 is placed on a platy first yoke 41 described later via a rectangular platy spacer 39 and a set of quadrilateral platy buffer materials 40.

As shown in FIG. 2, the position regulating plate 37 is made up of an elastic metal plate with a substantially rectangular front surface, and both side edges thereof are cut and raised to form elastic claws. The position regulating plate 37 is pressed into the slit 35*e* of the holder 35, to be pressed to be in contact with the movable yoke 48 in the holder 35. The position regulating plate 37 then makes the pressing force act on the movable contact piece 49 via the movable yoke 48, to regulate the spinning of the movable contact piece 49 and the movable yoke 48 described later.

As shown in FIG. 2, the arc extinguishing piece 38 has a gate shape (U-shape) in a cross section which is formed by performing press working on thin plate metal. Then, the arc extinguishing piece 38 is installed in a recess 35*f* (FIG. 15) of the holder 35 so as to quench and efficiently extinguish the arc generated at the time of switching the contacts.

As shown in FIG. 2, the buffer material 40 is a platy body made up of an elastic material. The buffer material 40 is sandwiched between the bottom surface of the holder 35 and the platy first yoke 41 covered by the spacer 39.

As shown in FIG. 2, the platy first yoke 41 has a plane shape that can be fit to the opening edge of the case 10. Further, a caulking hole 41*a* is provided in the center of the platy first yoke 41. The platy first yoke 41 is formed by welding and integrating the outer peripheral edge of the lower end of the metal cylindrical flange 31 to the outer peripheral edge of the upper surface of the platy first yoke 41. Further, the upper end of the cylindrical fixed iron core 42 is fixed to the caulking hole 41*a* of the platy first yoke 41.

One end of the movable shaft 43 is inserted through the holder 35, and the other end thereof is inserted through the inside of the electromagnetic unit 60. Meanwhile, the movable shaft 43 is reciprocatably supported in an axis center direction of the movable shaft 43. Specifically, as shown in FIG. 10, the movable shaft 43 is slidably inserted into a through hole 42*a* of the cylindrical fixed iron core 42 in the axis center direction of the movable shaft 43 via the cylindrical insulator 35*c* of the holder 35. An annular flange part 43*a* is provided in the upper part of the movable shaft 43. A return spring 44 is inserted through the lower part of the movable shaft 43, and a movable iron core 45 is fixed to the lower end thereof.

The movable contact piece 49 is provided at one end of the movable shaft 43 and housed in the holder 35. Further, the movable contact piece 49 has a pair of movable contacts 49*a*, 49*a* respectively on both ends in a direction intersecting with (e.g., orthogonal to) the axis center direction of the movable shaft 43 (i.e., on the front surface (upper surface) on the opposite side to the electromagnetic unit 60 in the axis center direction of the movable shaft 43). Specifically, as shown in FIG. 10, a contact spring 47, the movable yoke 48, and the movable contact piece 49, sequentially inserted through the movable shaft 43 from its upper end, are locked by an annular flange part 45*a*, and are retained to the movable shaft 43 by a retaining ring 50 fixed to its upper end.

The movable yoke 48 is disposed on the opposite side to a projecting direction of a pair of movable contacts 49*a*, 49*a* provided on the movable contact piece 49 (i.e., on the rear surface (lower surface) of the movable contact piece 49 on the electromagnetic unit 60 side in the axis center direction of the movable shaft 43), and is assembled to one end of the movable shaft 43. Specifically, as shown in FIG. 11, the movable yoke 48 is obtained by bending and raising both ends of a platy magnetic material 90 degrees, parallelly in the same direction, to form bent-and-raised parts 48*a*, 48*a*. The movable yoke 48 has a gate shape (U-shape) in a cross section. The movable yoke 48 comes into contact with the lower surface of the movable contact piece 49.

Further, the movable contact piece 49 has the movable contacts 49*a*, 49*a* by projection processing at both longitudinal ends of its upper surface. The movable contacts 49*a*, 49*a* face the fixed contacts 33*a*, 33*a*, respectively, of the fixed contact terminal 33 disposed in the holder 35 in a contactable and separable manner.

As shown in FIG. 10, the opening edge of the bottomed cylinder 46 is airtightly joined to the vicinity of the edge of the lower surface of the caulking hole 41*a* provided in the platy first yoke 41, the bottomed cylinder 46 housing the movable iron core 45 in the vicinity of its lower end. After the internal air is sucked from the gas vent pipe 34, the pipe is filed with gas and sealed to form a sealed space.

The fixed yoke 51 is located between the pair of fixed contacts 33*a*, 33*a* separately from the pair of fixed contacts 33*a*, 33*a*. The fixed yoke 51 is supported so as to bridge both longitudinal ends thereof in the holder, the both ends being along a direction intersecting with (e.g., orthogonal to) the axis center direction of the movable shaft 43 and intersecting with (e.g., orthogonal to) the longitudinal direction of the movable contact piece 49. Specifically, as shown in FIG. 2, the fixed yoke 51 is a platy magnetic material having a substantially I-shape on a plane, and having a gate shape (U-shape) in a cross section, with projections 51*a* projecting at both longitudinal ends so as to be bent at 90 degrees. Further, a longitudinal length dimension of the fixed yoke 51 is longer than a longitudinal length dimension of the movable yoke 48. Hence, the fixed yoke 51 is superimposed on the movable yoke 48 so as to cover the whole of the movable yoke 48 in the longitudinal direction, resulting in a little leakage of a magnetic flux and favorable magnetic efficiency. Then, the fixed yoke 51 is bridged with the pair of projections 51*a* (FIG. 16) placed on the pair of pedestals 35*d* of the holder 35 shown in FIG. 8. Further, as shown in FIG. 17, the positions of the respective ends of the fixed yoke 51 are regulated by a pair of position regulating ribs 35*g*, which is disposed on both sides of the adjacent pair of pedestals 35*d*, 35*d*, so as not to move in the longitudinal direction of the movable contact piece 49.

Meanwhile, at the time of switching the fixed contact 33*a* and the movable contact 49*a*, due to an arc generated between the fixed contact 33*a* and the movable contact 49*a*, friction powder is dispersed (hereinafter referred to as dispersed powder), the power being generated in association with the contact and opening between the fixed contact 33*a* and the movable contact 49*a*. For example, when the fixed yoke is directly fixed to the ceramic plate by brazing or the like, if the dispersed powder is disposed between the fixed contact terminal and the fixed yoke, a short circuit channel is undesirably formed between the fixed contact terminal and the fixed yoke, to cause significant deterioration in insulating properties of the contact switching device.

Figure 12:
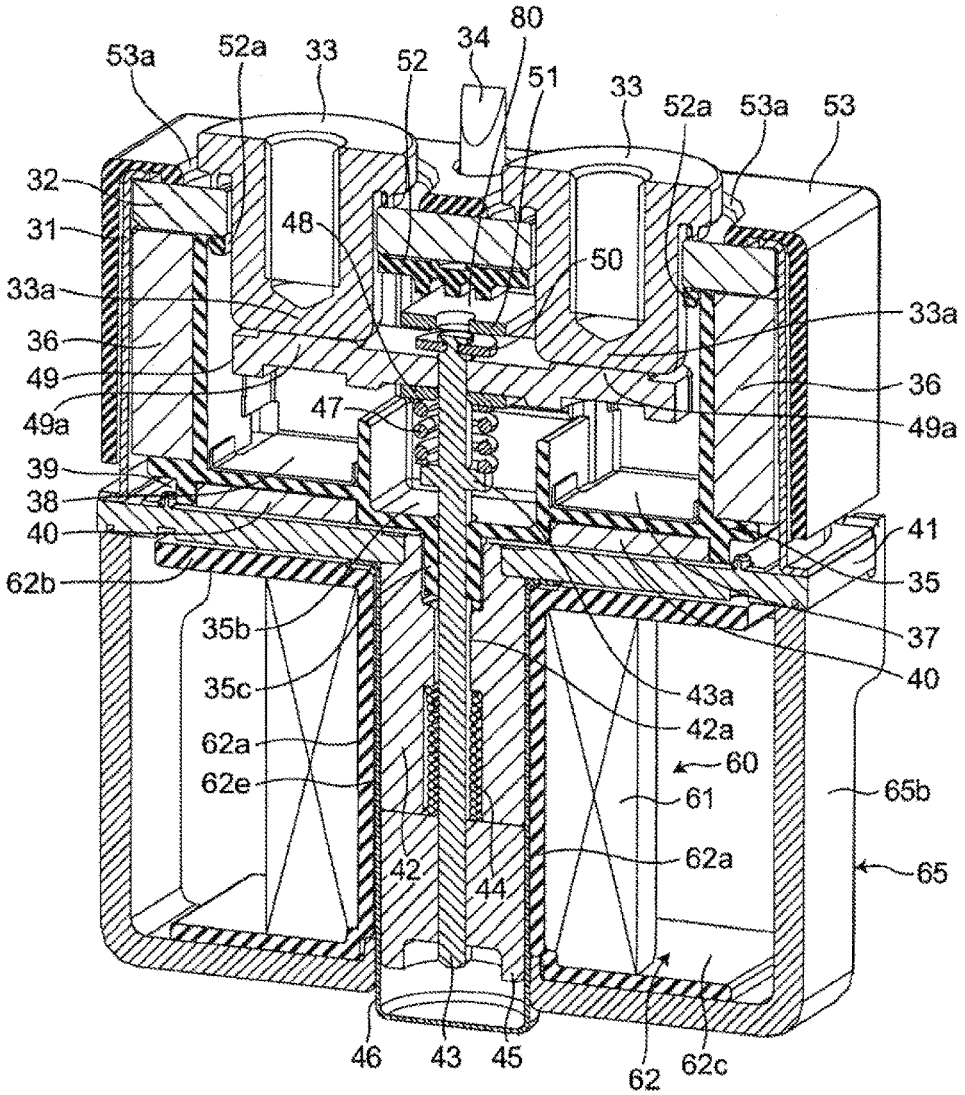
FIG. 12 is a front longitudinal sectional view after the operation illustrated in the perspective view shown in FIG. 3.

In the contact switching device, as shown in FIGS. 10 and 12, the fixed yoke 51 is held by the holder 35 made of resin, with an insulating property ensuring gap 80 formed between the fixed yoke 51 and the ceramic plate 32. Accordingly, even when the dispersed powder is disposed between the fixed contact terminal 33 and the fixed yoke 51, the insulating property ensuring gap 80 is not filled. Hence, the short circuit channel is hardly formed between the fixed contact terminal and the fixed yoke, enabling prevention of deterioration in insulating properties of the contact switching device.

Figure 6:
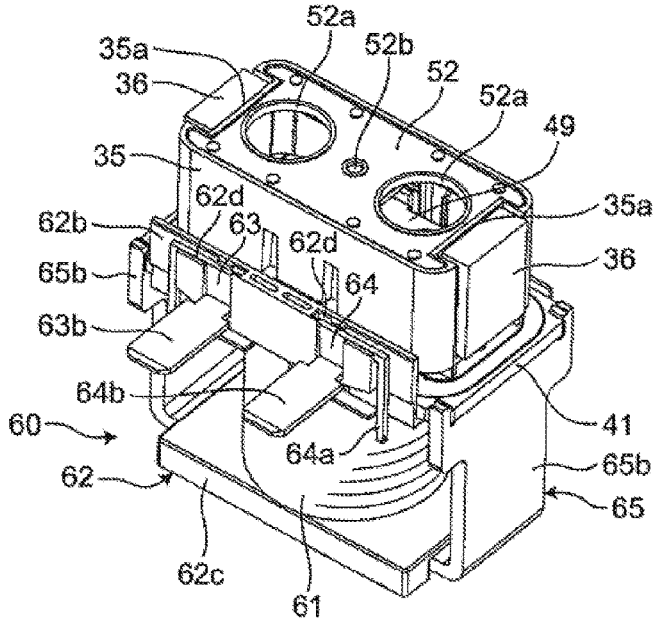
FIG. 6 is a perspective view showing a state where a ceramic plate, a fixed contact terminal, and a gas vent pipe are removed from the perspective view shown in FIG. 5.
Figure 7:
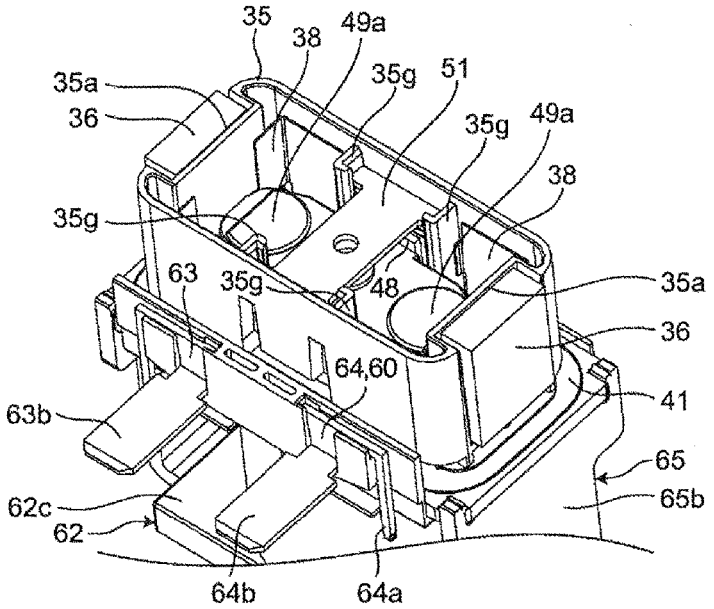
FIG. 7 is a perspective view showing a state where a lid is removed from the perspective view shown in FIG. 6.
Figure 8:
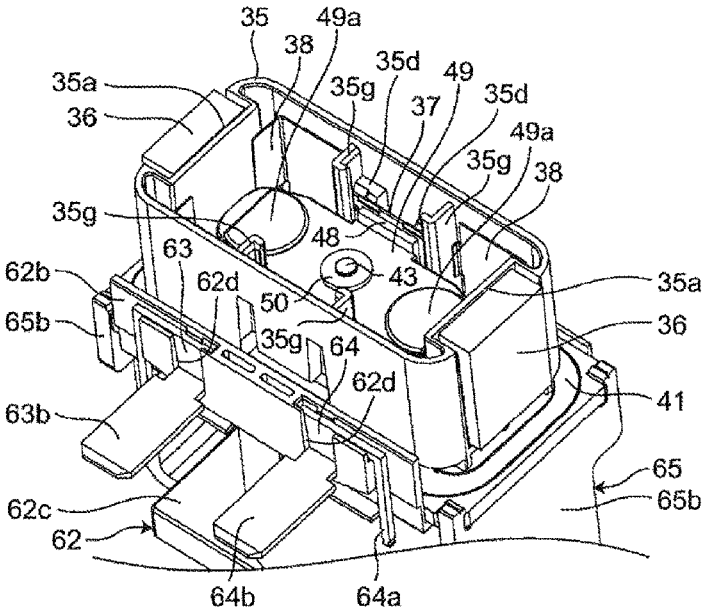
FIG. 8 is a perspective view showing a state where a fixed yoke is removed from the perspective view shown in FIG. 7.
Figure 9:
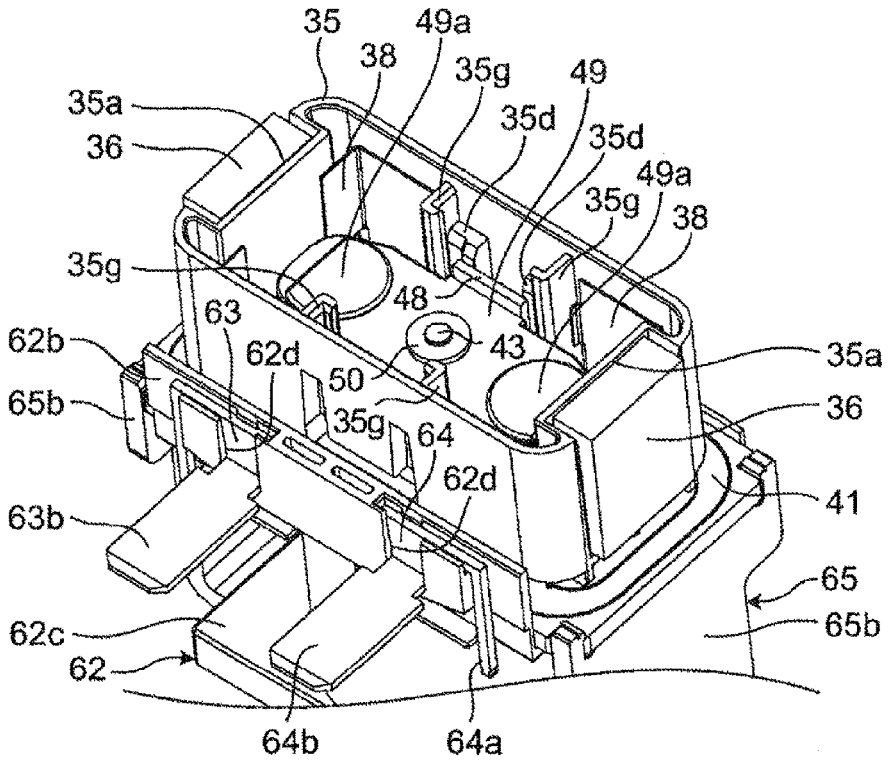
FIG. 9 is a perspective view showing a state where a position regulating plate is removed from the perspective view shown in FIG. 8.

As shown in FIG. 6, a lid 52 is an insulating platy body having a plane shape that can be fit to the opening of the holder 35. The lid 52 is provided with a through hole 52*b* between a pair of terminal holes 52*a*, 52*a* where the pair of fixed contact terminals 33, 33 are to be inserted.

An inner cover 53 is an insulating elastic body having a cubic shape capable of covering the metal cylindrical flange 31 brazed with the ceramic plate 32. As the inner cover 53, for example, a rubber material that easily absorbs collision sound between the movable contact 49*a* and the fixed contact 33*a* may be used. In the inner cover 53, a through hole 53*b* through which the gas vent pipe 34 penetrates is provided between a pair of terminal holes 53*a*, 53*a* which is provided on the ceiling surface of the inner cover 53 and through which the fixed contact terminals 33 respectively penetrate.

As shown in FIG. 2, the electromagnetic unit 60 is formed by winding a coil 61 around a trunk part 62*a* of an insulating spool 62. An upper-side flange part 62*b* and a lower-side flange part 62*c* are provided on both axial ends of the trunk part 62*a*. Coil terminals 63, 64 are respectively pressed and fixed into a pair of slits 62*d*, 62*d* provided in the upper-side flange part 62*b*. Further, a lead wire of the coil 61 is tied to tying parts 63*a*, 64*a* of the coil terminals 63, 64, and soldered thereto. Further, in the coil terminals 63, 64, terminal parts 63*b*, 64*b* thereof laterally project. Then, as shown in FIG. 10, the bottomed cylinder 46 is inserted through a through hole 62*e* provided in the trunk part 62*a* of the spool 62. Subsequently, the lower end of the bottomed cylinder 46 is fit to a fitting hole 65*a* of a second yoke 65. Then, the upper ends of both arms 65*b*, 65*b* of the second yoke 65 are respectively engaged and fixed to both ends of the platy first yoke 41. Examples of a method for the fixing include caulking, pressing-in, welding, and the like. As a result of the fixing, the electromagnetic unit 60 and the contact mechanism unit 30 are integrated.

Next, a description will be given of operation of the sealed electromagnetic relay including the foregoing configuration.

First, as shown in FIG. 10, when a voltage is not applied to the coil 61, the movable iron core 45 is biased downward with respect to the cylindrical fixed iron core 42 by spring force of the return spring 44. Hence, the movable shaft 43 integrated with the movable iron core 45 is pressed downward with respect to the cylindrical fixed iron core 42, and the movable contact piece 49 is pressed downward in the holder 35. At this time, the annular flange part 43*a* of the movable shaft 43 is engaged to the bottom surface of the central recess 35*b* of the holder 35. Thus, although the pair of movable contacts 49*a* are opened from the pair of fixed contacts 33*a*, the movable iron core 45 is not in contact with the bottom surface of the bottomed cylinder 46.

Figure 13:
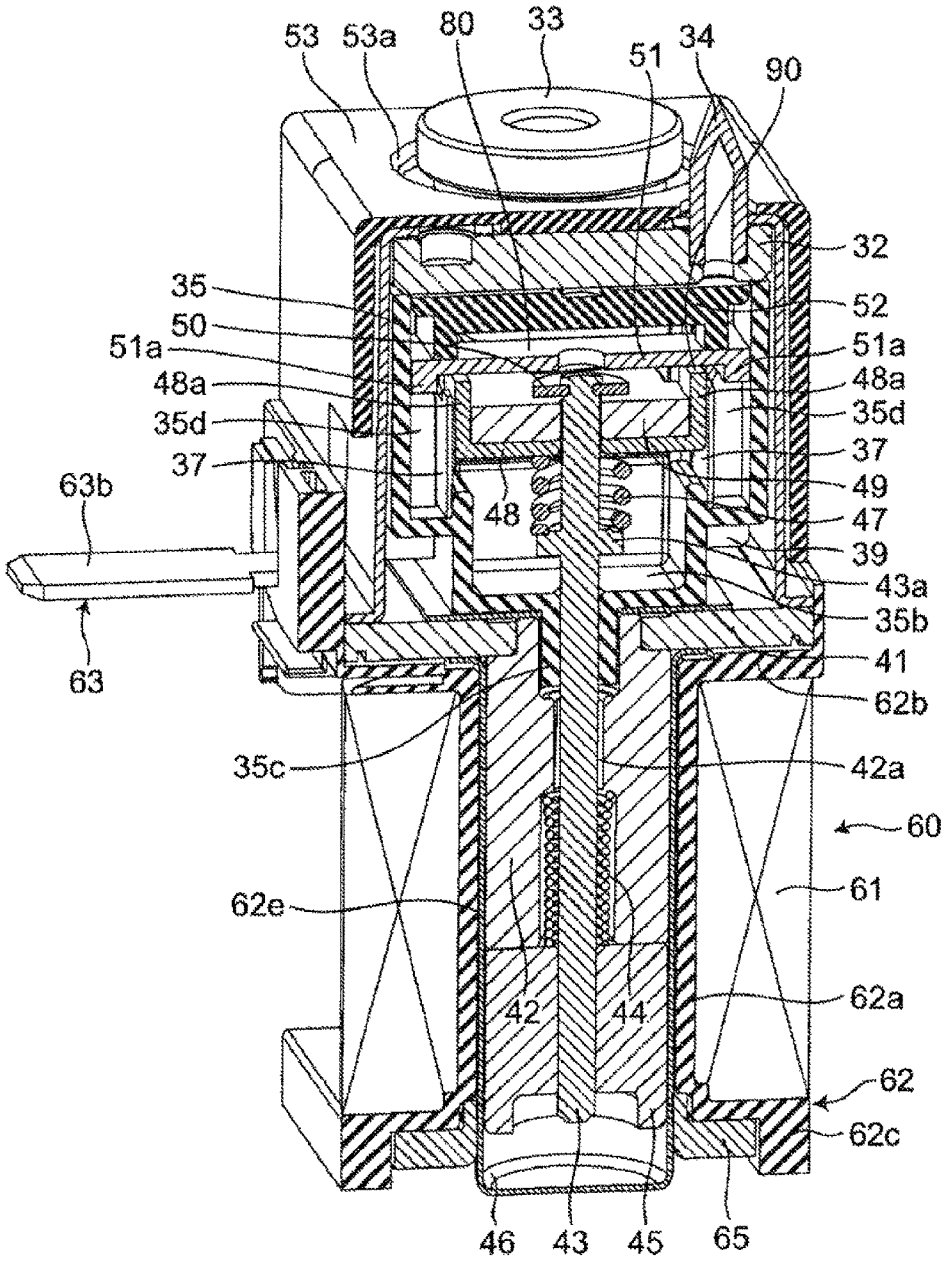
FIG. 13 is a lateral longitudinal sectional view after the operation illustrated in the perspective view shown in FIG. 3.
Figure 14:
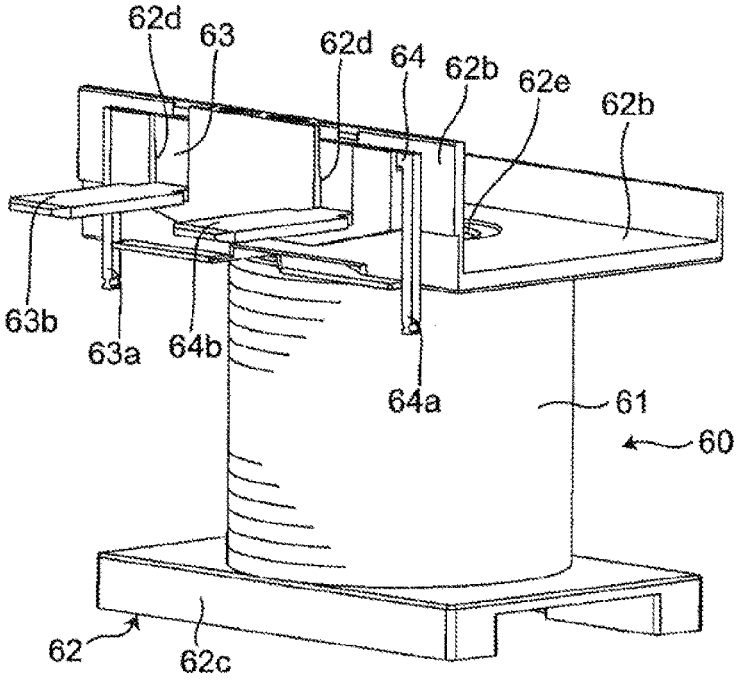
FIG. 14 is an enlarged perspective view of a part of an electromagnetic unit shown in FIG. 3.

Next, when a voltage is applied to the coil 61 for excitation, as shown in FIGS. 12, 13, the movable iron core 45 is magnetically attracted to the cylindrical fixed iron core 42. The movable shaft 43 thereby slides and moves upward along the axis center direction against the spring force of the return spring 44. Then, the pair of movable contacts 49*a* come into contact with the pair of fixed contacts 33*a*, and further, the movable shaft 43 is pushed up against the spring force of the return spring 44 and a contact spring 47. Hence, it is possible to ensure predetermined contact pressure between the pair of movable contacts 49*a* and the pair of fixed contacts 33*a*. Further, the movable yoke 48 comes closer to the fixed yoke 51. However, the fixed yoke 51 and the movable yoke 48 do not come into direct contact with each other, and a magnetic circuit is made while a predetermined contact reliability ensuring gap 90 is held. This is for ensuring the contact reliability by the contact reliability ensuring gap 90. In order to reliably form such a configuration, as one example, it is configured such that a facing distance between the fixed yoke 51 and the movable yoke 48 facing each other is larger than an inter-contact distance between the movable contact 49*a* and the fixed contact 33*a*.

Note that collision sound that is generated at the time of the movable contact 49*a* coming into contact with the fixed contact 33*a* is absorbed and reduced by the inner cover 53. Hence, a silent type electromagnetic relay is obtained.

In the embodiment, even when the movable yoke 48 superimposes with the fixed yoke 51 at the time of closing the contacts, the magnetic circuit is made while the contact reliability ensuring gap 90 is held between the yokes 48, 51. For this reason, magnetic force lines flow in the movable yoke 48 and the fixed yoke 51, to form a magnetic field. As a result, even when a large current flows in the movable contact piece 49 and electromagnetic repulsive force is generated between the fixed contact 33*a* and the movable contact 49*a*, attraction force is generated due to the magnetic field formed by the fixed yoke 51 and the movable yoke 48. By this attraction force, the movable yoke 48 is magnetically attracted by the fixed yoke 51 to suppress the electromagnetic repulsive force. Hence, there is an advantage of being able to prevent a decrease in contact pressure and opening of the contacts at the time of closing the contacts, thereby preventing generation of an arc and welding of the contacts.

Figure 16:
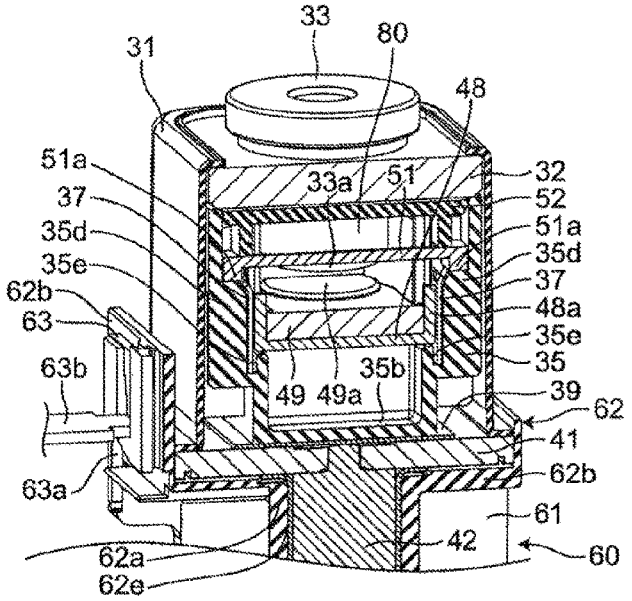
FIG. 16 is a lateral sectional perspective view of a part of the perspective view shown in FIG. 4.
Figure 17:
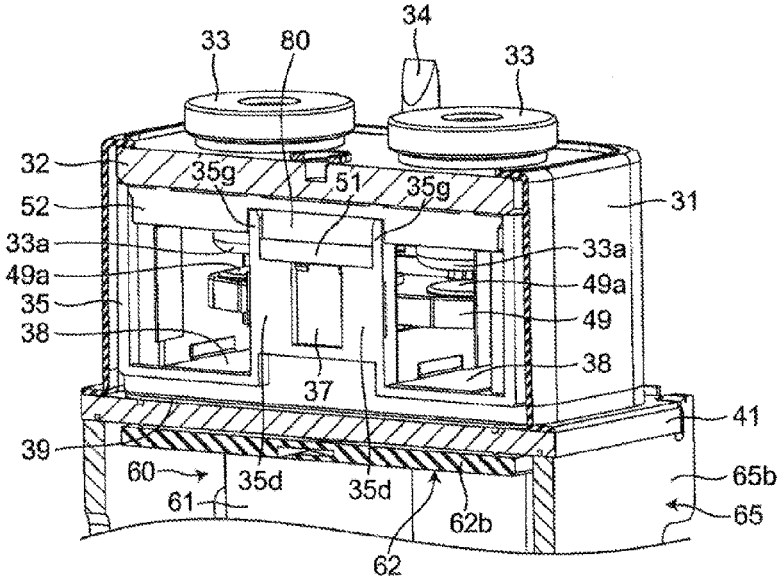
FIG. 17 is a front sectional perspective view of a part of the perspective view shown in FIG. 4.

In particular, as shown in FIG. 16, the fixed yoke 51 placed and bridged between the pedestals 35*d*, 35*d* of the holder 35 is fixed via the ceramic plate 32 provided with the lid 52 and the fixed contact 33*a*. Meanwhile, the movable yoke 48 is in contact with the lower surface of the movable contact piece 49 provided with the movable contact 49*a*. Accordingly, when the movable contact 49*a* comes into contact with the fixed contact 33*a*, the contact reliability ensuring gap 90 between the fixed yoke 51 and the movable yoke 48 can be formed with high dimensional accuracy. Hence, there is an advantage of being able to obtain an electromagnetic relay where operation characteristics hardly vary.

When the application of the voltage to the coil 61 is stopped to cancel the excitation, the movable iron core 45 is separated from the cylindrical fixed iron core 42 by spring force of the contact spring 47 and the return spring 44. Hence, the movable shaft 43 slides and moves downward, and the movable contact 49*a* is opened from the fixed contact 33*a*. Thereafter, the annular flange part 43*a* of the movable shaft 43 is engaged with the central recess 35*b* of the holder 35 and returned to the original state (FIGS. 10, 11).

In the embodiment, it is possible to form a desired contact reliability ensuring gap 90 by appropriately adjusting a height dimension of the pedestal 35*d* of the holder 35, a height dimension of a bent-and-raised part 48*a* of the movable yoke 48, a thickness dimension of the movable contact piece 49, and the projection 51*a* of the fixed yoke 51. Hence, there is an advantage that wide design flexibility is provided.

According to the embodiment, the fixed yoke 51 is supported by the holder 35 as a result of placing a pair of projections 51*a* (FIG. 16) of the fixed yoke 51 in the holder 35, thereby eliminating the need to fix the fixed yoke by brazing to the inner upper surface of the box-shaped container as is done in the conventional example. Hence, the assembly operation is simply performed, leading to high productivity and low manufacturing cost.

Further, since both ends of the fixed yoke only have to be placed in the holder, it is possible to obtain a contact switching device where an assembly error hardly occurs and the operation characteristics hardly vary.

Further, according to the embodiment, a pair of projections 51*a* of the fixed yoke 51 are placed on a pair of pedestals 35*d*, thereby facilitating the assembly operation for the fixed yoke.

As another embodiment of the present invention, the longitudinal length dimension of the fixed yoke may be made longer than the longitudinal length dimension of the movable yoke.

According to the embodiment, since the fixed yoke is superimposed on the movable yoke so as to cover the whole of the movable yoke in the longitudinal direction, it is possible to obtain a contact switching device with small leakage of a magnetic flux and with favorable magnetic efficiency.

As another embodiment of the present invention, the facing distance between the facing fixed yoke and movable yoke may be made longer than the inter-contact distance between the movable contact and the fixed contact.

According to the embodiment, even when the pair of movable contacts come into contact with the pair of fixed contacts, the movable yoke does not come into contact with the fixed yoke and, hence, the contact between the pair of movable contacts and the pair of fixed contacts is not prevented. Consequently, the contact switching device with high contact reliability can be obtained.

As another embodiment of the present invention, a gap may be provided so that the fixed yoke does not come into direct contact with the movable yoke when the movable contact comes into contact with the fixed contact.

According to the embodiment, even when the pair of movable contacts come into contact with the pair of fixed contacts, the movable yoke does not come into contact with the fixed yoke and, hence, the contact between the pair of movable contacts and the pair of fixed contacts is not prevented. Hence, the contact switching device with high contact reliability can be obtained.

As a new embodiment of the present invention, the movable yoke may be in contact with one surface of the movable contact piece on the opposite side to a projecting direction of the movable contact provided on the movable contact piece.

Further, according to the embodiment, since the movable contact piece 49 is in contact with the movable yoke 48, magnetic resistance of the magnetic circuit between the made up of the fixed yoke 51 and the movable yoke 48 becomes smaller. Hence, it is possible to obtain a contact switching device having favorable magnetic efficiency and capable of suppressing the electromagnetic repulsive force by large magnetic force.

Further, according to the embodiment, the collision force of the movable shaft 43 is absorbed into the buffer material 40 and reduced via the holder 35. In particular, even when the movable shaft 43 is returned to the original state, the movable iron core 45 does not come into contact with the bottom surface of the bottomed cylinder 46. For this reason, collision sound of the movable shaft 43 is absorbed and reduced by the holder 35, the buffer material 40, the cylindrical fixed iron core 42, the inner cover 53, the electromagnetic unit 60, and the like. Hence, there is an advantage that the sealed electromagnetic relay with small switching sound can be obtained.

Further, according to the position regulating plate 37 of the embodiment, as shown in FIG. 11, the movable shaft 43 makes a vertical motion in response to a vertical motion of the movable contact piece 49. Also at this time, even when the movable contact piece 49 and the movable yoke 48 are slightly displaced, the movable yoke 48 comes into contact with the position regulating plate 37 pressed into the slit 35*e* (FIG. 15) of the holder 35 so that the position of the movable yoke 48 is regulated. For this reason, the movable contact piece 49 and the movable yoke 48 do not come into direct contact with the holder 35. As a result, no resin powder is generated and no contact failure occurs. In particular, since the position regulating plate 37 is formed of a metal material, abrasion powder is hardly generated.

Figure 18:
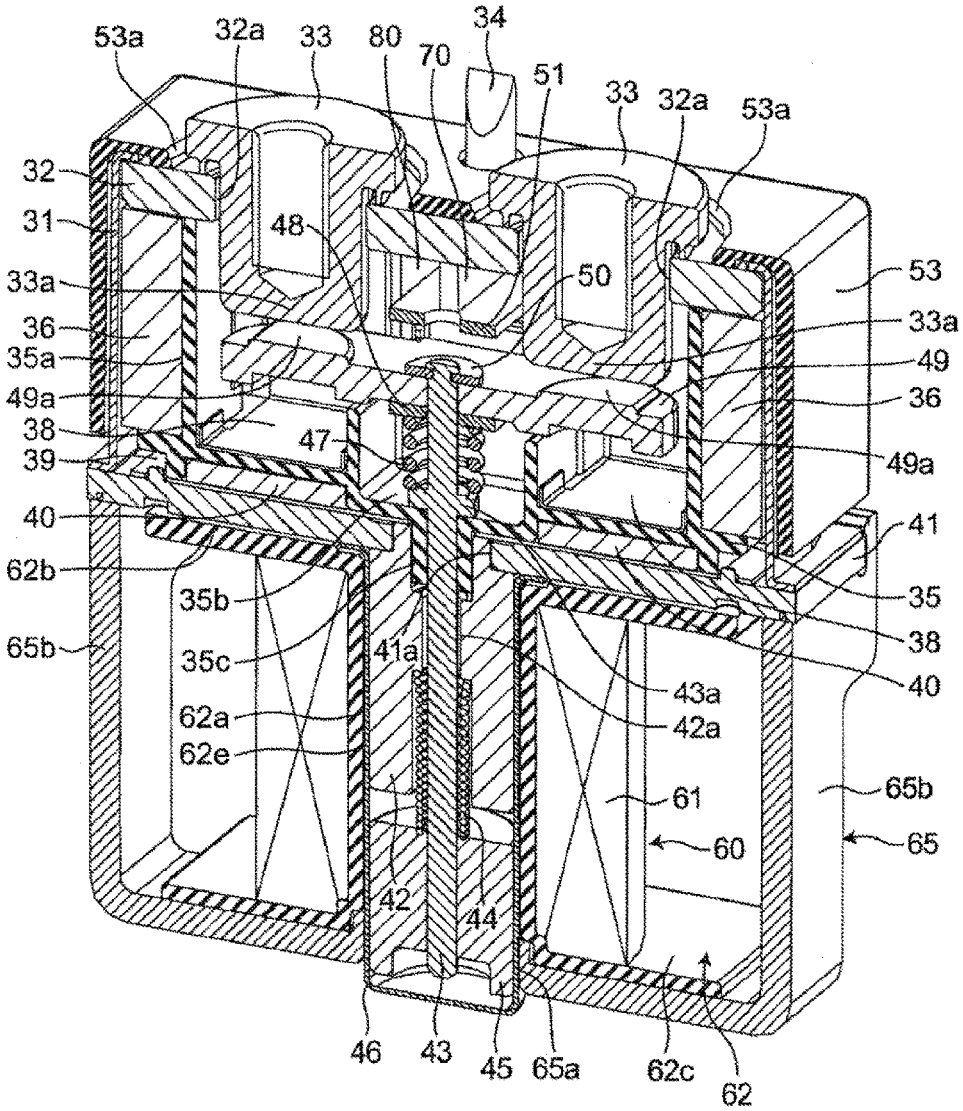
FIG. 18 is a front longitudinal sectional view showing a contact switching device according to another embodiment of the present invention before operation.
Figure 19:
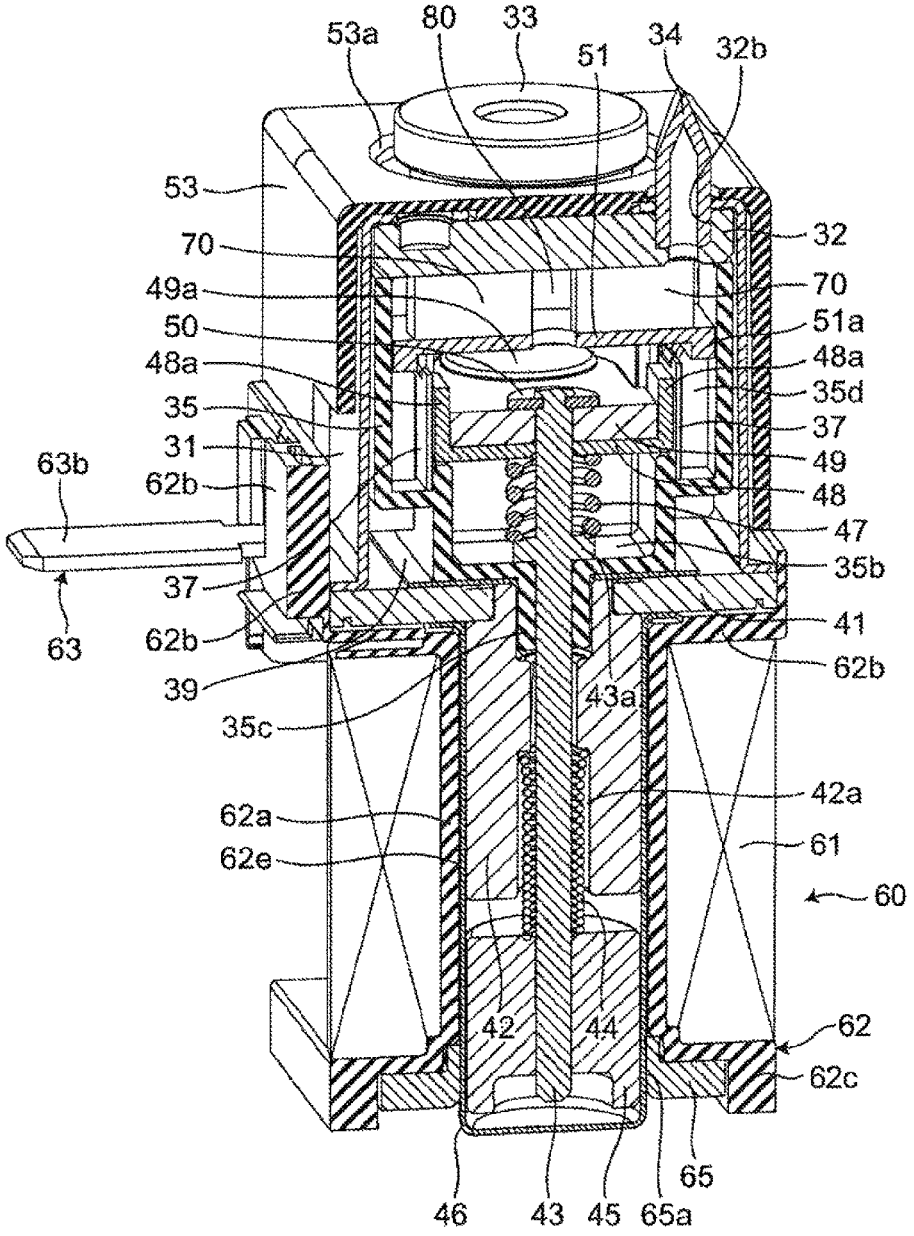
FIG. 19 is a lateral longitudinal sectional view of the contact switching device of FIG. 18.

In the contact switching device of the above embodiment, the fixed yoke 51 is held in the holder 35 made up of the insulating material, but this is not restrictive. For example, as shown in FIGS. 18 and 19, the fixed yoke 51 may be held by way of being connected to the ceramic plate 32 via a ceramic connector 70. Also in this instance, even when dispersed powder generated at the time of switching the fixed contact 33*a* and the movable contact 49*a* is disposed between the fixed contact terminal 33 and the fixed yoke 51, the insulating property ensuring gap 80 is not filled. Hence, the short circuit channel is hardly formed between the fixed contact terminal 33 and the fixed yoke 51 via the dispersed powder, enabling prevention of deterioration in insulating properties of the contact switching device.

The contact switching device according to the present invention is not limited to the foregoing electromagnetic relay, but may naturally be applied to another contact switching device.

The invention claimed is:

1. A contact switching device comprising:

an electromagnetic unit;

a holder mounted on the electromagnetic unit;

a movable shaft having one end inserted in the inside of the holder and the other end inserted in the inside of the electromagnetic unit, and supported reciprocatably in a direction of an axis center of the movable shaft;

a movable contact piece provided at the one end of the movable shaft in the holder and housed in the holder, while having a pair of movable contacts disposed on the front surface of the movable contact piece on the opposite side to the electromagnetic unit in the axis center direction of the movable shaft;

a movable yoke disposed on the rear surface of the movable contact piece on the electromagnetic unit side in the axis center direction of the movable shaft, and assembled to the one end of the movable shaft in the holder;

a pair of fixed contacts disposed in the holder and facing the pair of movable contacts in a contactable and separable manner; and a fixed yoke located between the pair of fixed contacts in the holder, such that the fixed yoke located between the pair of fixed contacts separately from the pair of fixed contacts, and extending in a longitudinal direction that intersects with the axis center direction of the movable shaft and intersects with a longitudinal direction of the movable contact piece without contacting the pair of fixed contacts, wherein the fixed yoke bridges between inside surfaces of the holder that face each other such that both longitudinal ends of the fixed yoke are placed on pedestals respectively projected in directions opposed to each other from the facing inside surfaces of the holder, wherein, at the time of excitation of the electromagnetic unit, the movable shaft moves in a direction from the electromagnetic unit to the holder along the axis center direction, a magnetic circuit is formed of the fixed yoke and the movable yoke due to a magnetic field generated by a current that flows into the movable contact piece as a result of the pair of movable contacts coming into contact with the pair of fixed contacts, and the movable yoke is magnetically attracted to the fixed yoke.

2. The contact switching device according to claim 1, wherein a longitudinal length dimension of the fixed yoke is longer than a longitudinal length dimension of the movable yoke.

3. The contact switching device according to claim 1, wherein a distance between the fixed yoke and the movable yoke facing each other is longer than a distance between the movable contact and the fixed contact facing each other.

4. The contact switching device according to claim 1, wherein a gap is provided between the fixed yoke and the movable yoke so that the fixed yoke does not come into direct contact with the movable yoke when the movable contact comes into contact with the fixed contact.

5. The contact switching device according to claim 1, wherein the movable yoke is in contact with the rear surface of the movable contact piece.

6. The contact switching device according to claim 1, wherein both longitudinal ends of the fixed yoke are placed on the pedestals respectively such that the pedestals prevent the fixed yoke from moving toward the movable yoke in the axis center direction.

7. The contact switching device according to claim 1, wherein each of the longitudinal ends of the fixed yoke is disposed between a pair of position regulating ribs projected from the facing inside surfaces of the holder, such that the position regulating ribs prevent the fixed yoke from moving in the longitudinal direction of the movable contact piece.

8. The contact switching device according to claim 1, further comprising a plate member to which the fixed contacts are fixed, and an insulating platy body between the plate member and the fixed yoke such that the fixed yoke does not contact the plate member.

9. The contact switching device according to claim 1, wherein the pedestals are respectively projected from the facing inside surfaces of the holder toward a longitudinal center of the fixed yoke in the directions opposed to each other.

10. The contact switching device according to claim 1, further comprising L-shaped position regulating ribs projected from the facing inside surfaces respectively and partially surround the pedestals respectively, wherein the L-shaped position regulating ribs regulate the position of the longitudinal ends of the fixed yoke.

* * * * *